United States Patent [19]

O'Connor

[11] 3,983,857

[45] Oct. 5, 1976

[54] COMBINATION PRIMER AND PUMP FOR INTERNAL COMBUSTION ENGINES

[75] Inventor: Alton J. O'Connor, Cass City, Mich.

[73] Assignee: Walbro Corporation, Cass City, Mich.

[22] Filed: Feb. 26, 1975

[21] Appl. No.: 553,085

[52] U.S. Cl. ..... 123/187.5 R; 123/139 A; 123/DIG. 5; 417/394; 417/478

[51] Int. Cl.[2] ..... F02M 1/16

[58] Field of Search.. 123/139 A, 139 AA, 139 AH, 123/187.5 R, DIG. 5; 417/383, 394, 478

[56] References Cited

UNITED STATES PATENTS

| | | | |
|---|---|---|---|
| 1,551,041 | 8/1925 | Mercer | 123/187.5 R |
| 2,860,009 | 11/1958 | Orr | 123/187.5 R |
| 2,935,057 | 5/1960 | Perlewitz | 123/DIG. 5 |
| 2,984,188 | 5/1961 | Tuckey et al. | 417/394 |
| 3,007,416 | 11/1961 | Childs | 417/394 |
| 3,037,497 | 6/1962 | Roberson | 417/394 |
| 3,158,104 | 11/1964 | Hutchinson | 417/478 |
| 3,371,658 | 3/1968 | Turner | 123/187.5 R |
| 3,604,016 | 9/1971 | Robinson | 417/394 |

*Primary Examiner*—Wendell E. Burns
*Assistant Examiner*—David D. Reynolds
*Attorney, Agent, or Firm*—Barnes, Kisselle, Raisch & Choate

[57] ABSTRACT

A combination primer and pump for internal combustion engines which utilizes a flexible cylindrical housing having a flexing liner with unidirectional valves at each end. The walls of the cylinder permit manual flexing or squeezing to pump fuel and also a pulse connection in the outer housing serves as a valve to connect the crankcase pulse of an engine being supplied with fuel to the inner liner to permit pumping action to take place when the engine is running. The pulse connection may also serve as a control for the pulse pressure and thus for the fuel flow and pressure.

6 Claims, 3 Drawing Figures

FIG. 1
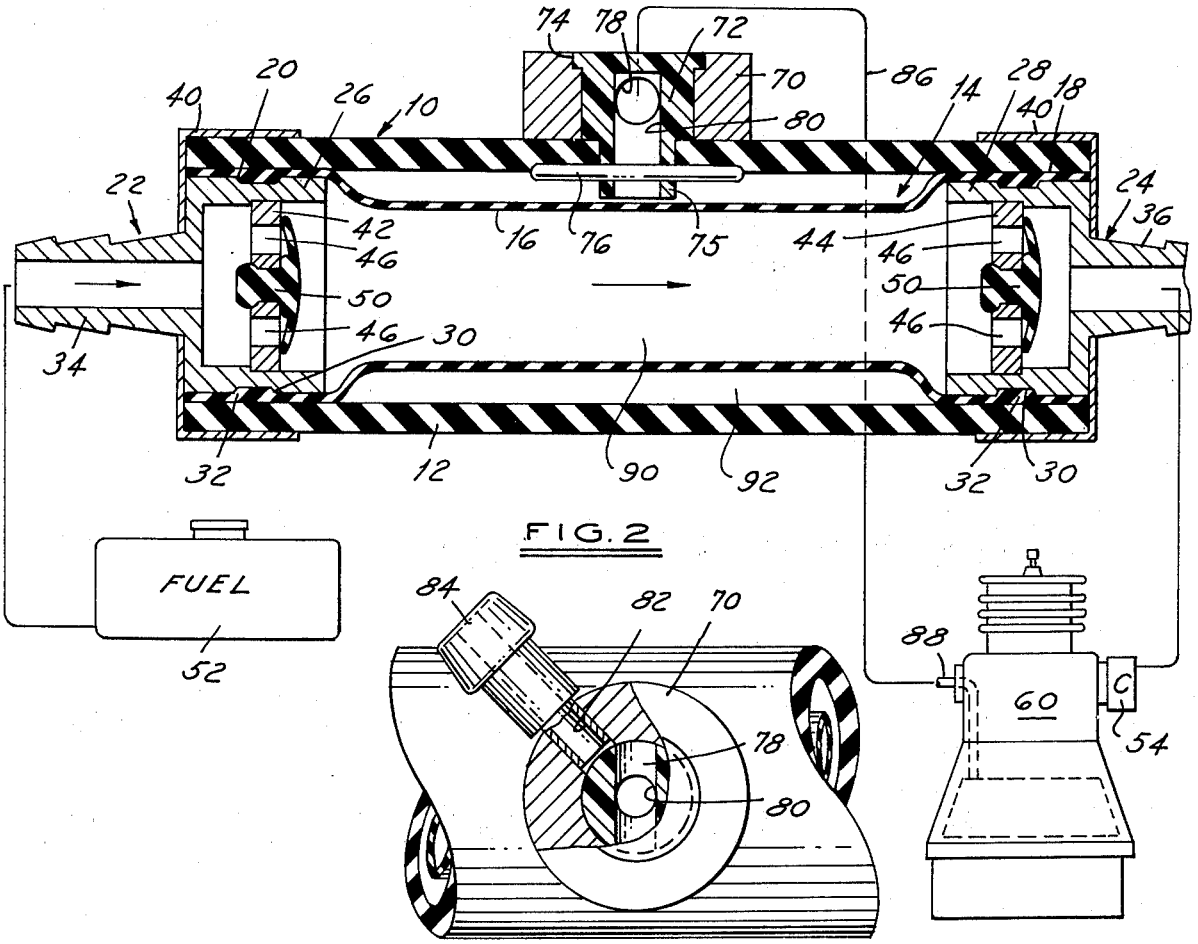
FIG. 2
FIG. 3
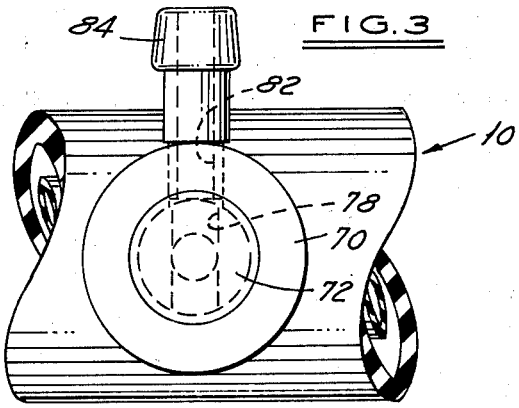

COMBINATION PRIMER AND PUMP FOR INTERNAL COMBUSTION ENGINES

This invention relates to a Combination Primer and Pump for Internal Combustion Engines. More particularly, the invention is directed to a single unit which can serve not only as a manual primer for small engines such as those used on lawn mowers, snowmobiles and other similar applications, but also has a pulse pump which will serve as a fuel pump for the engine in normal operation after starting.

It is an object of the present invention to provide a relatively simple and inexpensive pumping element which can serve the double function and which yet will be inexpensive to manufacture and serviceable over long periods of time.

It is an object to provide a pumping unit which has a novel end construction which provides for permanance as well as ease of assembly.

Another object is the provision of a valve which makes it simple for an operator to adjust the unit from a primer unit to a pulse-pump unit.

Other objects and features of the invention will be apparent in the following description and claims in which the principles of the invention are set forth together with the best mode presently contemplated for the practice of the invention.

Drawings accompany the disclosure and the various views thereof may be briefly described as:

FIG. 1, a view of the primer and pump unit in section showing the diagrammatic relationship to the elements of an engine system.

FIG. 2, a view taken from the top of FIG. 1, partially in section.

FIG. 3, a view similar to FIG. 2 showing the control valve in an open position.

Referring to the drawings:

In FIG. 1, the combination primer and pump unit is shown generally at 10 having an outer flexible housing wall 12 cylindrical in shape and open at each end. The wall 12 is formed of a flexible material such as neoprene or other similar material which is resistant to hydrocarbons and which can be easily flexed with the fingers. The thickness of this wall in the embodiment shown can be about 3 to 4 millimeters, the length around 7½ centimeters, and the overall outside diameter about 2½ centimeters.

Within the cylinder 12 is a liner member 14 also open at the ends having a restricted portion 16 along most of its length, the ends 18 and 20 being enlarged to have an outer diameter similar to that of the inside diameter of the element 12. This element 14 can be formed of a rather thin pliant material. It may be desirable to make the element 14 out of a material which can have a normal diameter shown at 16 and the ends can be stretched to the larger diameter when applied to the respective end pieces 22 and 24. These end pieces have an open-ended cylindrical portion 26 and 28, respectively, having an external groove 30 which can receive a small internal ridge 32 on the inside of the end portions 18 and 20. The elements 22 and 24 each have an extending nipple 34 and 36, respectively, for connection to fuel conduits. A retaining collar 40 made of metal, for example, brass, or made of a dense plastic, slips over the unit at each end to retain the concentric parts in assembly. If metal is used, it may be crimped in place. A central hole in each collar receives the projecting connector elements 34 and 36. If desired, a suitable bonding material can be applied between the elements to assist in their retention.

Pressed into the open end of each element 26 and 28 are valve plates 42 and 44, respectively, located against a shoulder and having annularly spaced fuel openings 46, each carrying, in a central opening, a stem of a flexible disc-like valve element 50. The valve elements 50 are each formed of a pliant material such as neoprene which has flexible annular sides which can open to uncover the openings 46 when the flow is in one direction and which will close to block these openings when pressure is applied in the other direction. Thus, it will be seen that flow through the unit illustrated in FIG. 1 will be from left to right. The nipple 34 is connected by a suitable conduit to a fuel supply tank 52 and the nipple 36 is connected to a carburetor 54 on an engine 60.

On the top of the unit, as illustrated in FIG. 1, is a cylindrical valve ring 70 which is shown also in FIGS. 2 and 3. This ring 70 is mounted for rotation on a small hollow cap member 72, having a shoulder 74 which retains the ring 70 against the top wall of the cylinder 10. This cap portion 72 has a small projection 75 extending through the wall of the cylinder 10 and retained by a transfixing pin 76. The wall of the cap 72 is drilled diametrically to provide a cross-passage 78 which is open to the central passage 80 of the cap. Valve ring 70 also has a radial passage 82 which receives a tubular root of a fixture 84 and which is positioned to register with the cross-passage 78 in a certain position of adjustment. For example, in FIG. 2, the passage 82 and connector fixture 84 is shown blocked from the passage 78. In FIG. 3, a 45° turn has placed the opening 82 in alignment with the opening 78. The connector fixture 84 is mounted on the ring 70 in the opening 82 to provide a tube connector for a tube 86 which connects to a nipple 88 on the side of the engine 60 so that it receives pulses from the crankcase of the engine.

In the assembly of the unit, it will be seen that the ends of the tube 16 can be slipped over the cylindrical elements 26 and 28 with the grooves and ridges engaged. The element 10 is prepared by assembling the unit 70–72 on one side thereof and installing the retaining pin 76. Then the inner elements are assembled within the tube 10 and the retaining rings 40 are applied to hold all the elements in the position shown.

In the operation of the unit, when the valve ring 70 is in the position shown in FIG. 2, the opening 80 and the cross-passages 78 are blocked by the walls of the ring 70. In this condition, an operator can squeeze the walls of the flexible element 10 to compress the inner liner 16 and create a manual pumping action which will ensmall and enlarge the chamber 90 within the element 16. This will force fluid from this chamber out through the plate 44 at the righthand end and, upon release, cause fuel to enter from the tank through the valve 42. In this way, fluid can be forced from the fuel supply to the carburetor 54 and the engine 60 making it possible to start the engine with an adequate supply of fuel. Once the engine has been started and warmed up sufficiently, the fixture 84, which can serve as a handle, can be moved to the position shown in FIG. 3 so that pulses from the engine crankcase can pass through the conduit 86 to the space 92 between the wall 10 and the liner 16. Since the wall 12 has a consistency similar to that, for example, of a rubber garden hose, and the wall 16 is much more flexible such as something like a rubber balloon, the pulsing of air into the chamber 92 between the walls of these two elements will cause the collapse and expansion of the wall 16 by reason of its inherent pliability and stretchability. It will compress as a result of the pulse from the engine and expand by reason of its inherent resilience plus the effect of a low pressure pulse in contrast to the high pressure pulse. The outer wall 12 has sufficient strength that it will resist change of dimension due to the engine pulses. Thus, the assembly begins to serve as a pump and fuel will be drawn from the fuel tank 52 and pass through the pump into the carburetor.

The valve passage 78 can also be positioned relative to the port 82 to a partly open position to limit the pulse effect and thus limit the pressure and flow of the fuel issuing from the pump.

I claim:

1. A fuel pump and manual primer which comprises:
   a. a pair of elongate concentric unsheathed pliant tubes, the outer tube having a stiffer wall than the inner tube,
   b. a closure at each end of said tubes having passages serving as inlet and outlet, respectively, to be connected to a fuel supply and an engine, and
   c. a unidirectional valve in each of said closures, wherein manual squeezing pressure on said outer tube causes said inner tube to deflate and inflate to effect movement of fuel through said inner tube.

2. A fuel pump and manual primer as defined in claim 1 in which means is provided selectively to connect a source of pulsing pressure to a pulse chamber space between said tubes.

3. A fuel pump and manual primer as defined in claim 2 in which said means comprises a first member valve mounted in the wall of the outer tube and a second valve member rotatable on said first valve member and including a connector fixture for an engine pulse tube, said second valve member being movable by manipulation of said fixture to an open and closed position and to intermediate positions to control the pulsing pressure reaching the pulse chamber between said tubes.

4. A fuel pump and manual primer as defined in claim 2 in which said means comprises a cap penetrating the wall of said outer tube, said cap having an axial passage connecting to a cross-passage, and a valve ring rotatably mounted on said cap having a radial engine pulse passage to register in an open position with said cross-passage in one position of said housing on said cap, said ring being movable to control the opening to the radial passage and thus control the flow and output pressure of said pump.

5. A fuel pump and manual primer as defined in claim 4 in which an engine pulse tube connecting fixture is inserted in and supported by the radial passage of said valve ring to conduct engine pulses to said pulse chamber between said tubes and to serve as a manual manipulator for said valve ring.

6. A fuel pump and manual primer as defined in claim 4 in which an engine pulse tube connecting fixture is supported by and extends from said valve ring in communication with said radial passage of said valve ring to conduct engine pulses to said pulse chamber between said inner and outer tubes and to serve as a manual manipulator for said valve ring.

* * * * *